United States Patent [19]

Trial

[11] 3,962,122

[45] June 8, 1976

[54] POLYAMIDE CORROSION INHIBITOR

[75] Inventor: Charles Ballard Trial, Odessa, Tex.

[73] Assignee: Atlantic Richfield Company, Los Angeles, Calif.

[22] Filed: June 24, 1975

[21] Appl. No.: 589,829

[52] U.S. Cl. ..... 252/392; 21/2.5 R; 21/2.7 R; 208/47; 252/8.55 E; 252/148

[51] Int. Cl.[2] ..... C23F 11/14

[58] Field of Search ..... 252/392, 8.55 E, 148; 21/2.7 R, 2.5 R; 208/47

[56] References Cited

UNITED STATES PATENTS

| | | | |
|---|---|---|---|
| 2,640,029 | 5/1953 | Blair et al. | 252/392 |
| 2,736,658 | 2/1956 | Pfohl et al. | 252/8.55 E |
| 2,901,430 | 8/1959 | Chiddix | 252/8.55 E |
| 2,944,968 | 7/1960 | Hutchison | 252/8.55 E |
| 2,976,179 | 3/1961 | Westlund | 252/392 |
| 3,134,759 | 5/1964 | Kirkpatrick | 252/8.55 E |
| 3,231,493 | 1/1966 | Edwards et al. | 252/8.55 E |
| 3,458,453 | 7/1969 | Kautsky | 252/392 |

*Primary Examiner*—Leland A. Sebastian
*Assistant Examiner*—Irwin Gluck
*Attorney, Agent, or Firm*—Coleman R. Reap

[57] ABSTRACT

Oil dispersible ferrous metal corrosion inhibitors are prepared by first forming a primary amine-terminated amide adduct by reacting a mixture of monomeric, dimeric and trimeric 1,6-hexanediamine with polyfunctional acids at a ratio of reactants such that the adduct is substantially completely terminated with primary amine groups and neutralizing the primary amine-terminated amide adduct with a carboxylic acid. Alternatively, water dispersible adducts may be prepared by reacting the primary amine-terminated amide adduct with an oxirane compound to produce a polyether derivative of the amine-terminated adduct.

16 Claims, No Drawings

POLYAMIDE CORROSION INHIBITOR

BACKGROUND OF THE INVENTION

1. Field

This invention relates to the inhibition of corrosion metals and, more particularly, to the inhibition of corrosion of ferrous metals which are exposed to acids, brines, oxygen and other corrosive materials.

Ferrous metals, particularly non-corrosion resistant steels, are very susceptible to corrosion by acids, brines, carbon dioxide, oxygen and many other substances. In spite of the fact that crude oil removed from the ground contains large amounts of these corrosive substances non-corrosion resistant steels are widely used in drilling for and the removal of oil from the ground, and for its transportation and storage after it has been pumped to the surface. The reason for this, of course, is that corrosion resistant ferrous metals, such as nickel-chromium stainless steel are too costly for general use and most non-ferrous metals, in addition to being very costly, lack the strength required in oil-producing and handling equipment.

2. Prior Art

In order to extend the useful life of ferrous metals which are exposed to highly corrosive substances the surfaces of the metals are generally treated with corrosion inhibiting chemicals. This is accomplished by direct application of the inhibitor to the metal surface where possible or, if the surface to be protected is the interior of a pipeline or vessel, by injecting the inhibitor into the fluid being carried through the pipeline or into the vessel.

U.S. Pat. No. 3,231,493, discloses the use of polyamide adducts as corrosion inhibitors. These adducts are prepared by reacting organic acids; high boiling amine residues prepared by reacting monoethanolamine, ethylenediamine or ethylene glycol with ammonia; and an alkylene oxide, alkylene carbonate or an aralkylene carbonate. U.S. Pat. No. 2,944,968 discloses the use of diamides made from polyalkyleneamines and monocarboxy naphthenic acids as ferrous metal corrosion inhibitors. The alkylene portion of the polyalkyleneamines may consist of as many as six carbon atoms. Other U.S. Pat. Nos. of interest include 2,640,029, 2,736,658, 2,901,430, 2,976,179 and 3,134,759.

SUMMARY OF THE INVENTION

In accordance with this invention, polyamide-based corrosion inhibitors for ferrous metals are presented which provide superior protection and which can be easily deposited onto metal surfaces from aqueous or organic liquids. Accordingly, it is an object of the invention to present improved corrosion inhibitors for ferrous metal surfaces. It is another object of the invention to present improved polyamide-based corrosion inhibitors for ferrous metal oil well casings, piping and storage facilities. It is another object of the invention to present improved polyamide-based corrosion inhibitors which are easily deposited onto metal surfaces from organic liquids. It is another objective of the invention to present improved polyamide-based corrosion inhibitors which are easily deposited onto metal surfaces from aqueous liquids. It is another object of the invention to present improved ferrous metal corrosion inhibitors which are easily prepared from low cost materials.

The above and other objects of the invention are accomplished by condensing one or more polyfunctional aliphatic carboxylic acids with a stoichiometric excess of a mixture comprised substantially of monomeric, dimeric, and trimeric 1,6-hexanediamine to produce a substantially amine-terminated polyamide and reacting this product with an aliphatic acid having 2 to 60 carbon atoms to produce an oil-dispersible corrosion inhibitor having a molecular weight of about 800–1500. In an alternate embodiment the unneutralized amine-terminated polyamide is reacted with an alkylene oxide containing 2 to 6 carbon atoms to produce a corrosion inhibitor which is either water dispersible or oil dispersible, depending on the particular alkylene oxide used.

DESCRIPTION OF THE INVENTION

The Polyamine Component

The polyamine component used in the preparation of the products of the invention is a mixture comprised substantially of 1,6-hexanediamine monomer, the dimer of 1,6-hexanediamine and the trimer of 1,6-hexanediamine. The polyamine component has the structural formula $$NH_2-(CH_2)_6-[NH(CH_2)_6]_n-NH_2$$

wherein $n$ is 0 to 2. As can be seen, the essential polyamine components used in the preparation of the products of the present invention contain two terminal amine groups and no, one or two internal secondary amine groups.

Useful polyamine components contain, on a weight basis, about 1 to 50%, 1,6-hexanediamine, about 10 to 60% 1,6-hexanediamine dimer and about 10 to 70% 1,6-hexane-diamine trimer. The preferred composition of the polyamine component, on a weight basis, is about 1 to 35% 1,6-hexanediamine, about 20 to 40% 1,6-hexanediamine dimer, and about 30 to 60% 1,6-hexanediamine trimer. Compositions containing 1,6-hexanediamine monomer, dimer and trimer contents in these ranges are conveniently obtained as the bottoms product from the distillation unit of a 1,6-hexanediamine production plant. The bottoms product from such units often contains minor amounts, e.g., up to about 15% by weight, of higher polymeric derivatives of 1,6-hexanediamine, i.e., compounds in which $n$ is greater than 2 or branched-chain compounds wherein the side chain is terminated with a primary amine group and is attached to a tertiary amine group in the main chain and up to about 5% of other impurities, but these additional ingredients do not significantly improve or detract from the effectiveness of the corrosion inhibitor and, consequently, these bottoms products can be used in the preparation of the compositions of the invention without further purification. The polyamine component may contain non-interfering substituents, i.e., substituents which do not interfere with the reaction between the reactive components of the inhibitor or the effectiveness of the product as a corrosion inhibitor.

The Organic Acid Component

The organic acid component which is reacted with the polyamine component is a mixture comprised essentially of monomeric, dimeric and trimeric branched or straight chain, saturated and/or unsaturated aliphatic acids and resin acids having 15 to 60 carbon atoms. By the expression "comprised essentially of" is meant that the monomeric, dimeric and trimeric aliphatic acids are necessary constituents of the organic acid component, however other organic acids, such as higher polymeric derivatives of the above acids, and unsaponifiable oils may be present in smaller amounts. These latter components are regarded as impurities and it is preferred that the organic acid compon ent contain at least 85 and most preferably at least 90% of the mixture of monomer, dimer, and trimer acids. The monomer acid component is substantially all monofunctional, is comprised of saturated or ethylenically unsaturated aliphatic acids and resin acids having about 15 to 23 carbon atoms and is present in the organic acid reactant in an amount of about 10 to 40% and preferably about 20 to 30% by weight of the acid reactant. The term monomer acid, as used in this disclosure, includes saturated as well as ethylenically unsaturated acids even though the saturated acids do not readily undergo addition polymerization and are, therefore, not true monomers. Typical monomer acids which may be present in the organic acid component include saturated aliphatic acids, such as palmitic acid, stearic acid, arachidic acid, 14-ethylhexadecanoic acid; unsaturated aliphatic acids, such as oleic acid, linoleic acid, and linolenic acid; and resin acids, such as the abietic acids and the primaric acids. The dimer acids are principally difunctional dimers of the unsaturated monomer acids such as dioleic acid and the trimer acids are principally trifunctional trimers of the unsaturated monomer acids, for example, trilinoleic acid. The dimer acids are present in the organic acid component at a concentration of about 20 to 70% and preferably about 30 to 55% and the trimer acids are present at a concentration of about 10 to 40% and preferably about 15 to 30%, based on the total weight of the organic acid component. As is the case with the polyamine component the organic acid component may contain compounds having atoms or groups which do not interfere with the reactivity of the reactants and which do not otherwise alter the properties of the corrosion inhibitor in an undesirable manner. Examples of non-interfering atoms or groups which may be present in the organic acid component are halogen, hydroxy and ketone substituents and these may be attached to the essential constituents or to the impurities. The organic acid component may also contain small amounts, e.g., up to about 15% but preferably not more than 10% by weight of unsaponifiable oils and other impurities.

In preparing the products of the invention primary amine-terminated amide adducts are first prepared by reacting the polyamine and organic acid components under conditions such that internal amide groups are formed and the terminal groups on the initial reaction product will be substantially all primary amine groups. The primary amine-terminated adducts can be prepared by reacting the polyamine component and the organic acid component in a ratio of about 1.8 to 3.0, and preferably about 2.0 to 2.5, equivalents of primary amine per each equivalent of acid. The term "equivalents" is used in its ordinary sense and, accordingly, each free primary amine and each free carboxyl on the reactant compounds is one equivalent. The primary amine-terminated amide adducts are formed by carrying out the reaction at a temperature of about 100° to 195°C and preferably about 130° to 175°C. At these temperatures the desired amide groups will be formed rather than the amine-acid salts.

The adduct-forming reaction is preferably carried out in the presence of a solvent, although a solvent is not necessary when relatively low molecular weight products are produced. If it is desired to use a solvent any of the ordinary solvents in which both reactants are soluble and which are inert to the reactants and the product can be used. Typical solvents include the aromatic solvents such as benzene, toluene, xylene, etc., and those aliphatic liquids and halogenated hydrocarbons in which both reactants are soluble.

In accordance with one embodiment of the invention, salts of the primary amine-terminated adducts are formed by neutralizing the primary amine groups of the adduct with an organic acid at a temperature below that at which amide linkages are formed between the primary amine groups of the adduct and the carboxyl groups of the neutralizing acid. This is accomplished by mixing the amine-terminated amide with the neutralizing acid and maintaining the mixture at a temperature below about 100°C until the neutralization is completed or substantially completed. When using lower molecular weight acids such as those having up to 12 carbon atoms it is preferred that the amine-amide adduct and neutralizing acid be used in stoichiometric amounts necessary for complete neutralization. However, when neutralizing with higher molecular weight acids such as oleic, linoleic, etc., the acid is often present in an excess since it acts somewhat as a corrosion inhibitor. Suitable neutralizing acids include the monofunctional aliphatic and aromatic acids having 2 to 20 carbon atoms and which are free of groups or atoms which would interfere with the effectiveness of the product as a corrosion inhibitor, and the monomeric, dimeric and trimeric acids used in the preparation of the amine-amide adducts. Typical acids useful for neutralizing the amineterminated amide adducts are the monofunctional carboxylic acids, such as, acetic acid, propionic acid, decanoic acid, lauric acid, stearic acid, acrylic acid, oleic acid, linoleic acid, benzoic acid, etc., and the di- and tri-functional higher homologues of the named unsaturated acids. The neutralized amide adducts have excellent dispersibility in oil-based organic liquids such as crude oil and crude oil-water mixtures which are pumped out of the earth and they can be blended with such organic liquids and pumped down into a well casing or through piping, etc. The amine salts are deposited onto the metal surfaces with which they come in contact.

According to another embodiment of the invention the primary amine-terminated amide adduct is reacted with a saturated aliphatic oxirane compound containing 2 to 6 carbon atoms to produce alkoxylated amide products having good oil dispersibility or good water dispersibility depending on which oxirane compound is used. Products prepared according to this embodiment are particularly suitable for use in aqueous liquids or aqueous liquid-organic liquid mixtures, such as brine-crude oil mixtures in which the acid-neutralized products may lack good dispersibility. Suitable oxirane compounds, i.e., those in which the oxygen atom is bridged to adjacent carbon atoms include oxirane, methyloxirane, 2,3-dimethyloxirane, 2-methyl-3-propyloxirane, 2,2,3,3-tetramethyloxirane, etc. The properties of the alkoxylated amides prepared according to this embodiment are dependent upon the particular oxirane compound reacted with the amine-terminated amide and the length of the alkoxy groups or polyether groups appended to the amine-terminated amide. In general, products having better water solubility or dispersibility are prepared from oxirane compounds having a high oxygen to carbon ratio. Thus, ethylene oxide is preferably used when it is desired to produce water-soluble or waterdispersible products, and higher oxirane homologs, such as propylene oxide or butylene oxide, are used when it is desired to produce oil dispersible products. As can be appreciated, it is desirable to use oil-dispersible corrosion inhibitors when the vehicle used to carry the inhibitor is an oil or oily organic liquid and watersoluble or water-dispersible corrosion inhibitors are preferred for use in fluids which are aqueous in nature, such as the water which is pumped down well casings to force the oil from the earth or when the oil being pumped out of the ground contains a large amount of brine. In this embodiment of the invention the product contains about 10 to 75% and preferably 25–65% of alkylene oxide, based on the total weight of alkylene oxide and amineterminated amide adduct in the product.

According to this embodiment the reaction product is prepared by mixing the oxirane compound and the amine-terminated amide adduct. The reaction is exothermic and will proceed immediately upon mixing of the reactants. A basic catalyst is added prior to or during the reaction to catalyze the reaction of the alkylene oxide with the hydroxyl groups formed upon the initial reaction between the alkylene oxide and the amine groups of the adduct. The reaction mixture is heated to and maintained at a temperature of about 120°–210°C and preferably 150°–190°C until the reaction is completed. Suitable catalysts are any of those usually used in the preparation of polyethers from alkylene oxides. Typical catalysts include the organic alkoxides, the alkali metal hydroxides, tertiary amines, etc. The particular catalyst used is not critical. The amount of catalyst used may vary from about 0.01 to 10% and preferably from about 0.1 to 5%, based on the weight of alkylene oxide used in the preparation of the product according to this embodiment.

In accordance with a preferred embodiment of the invention, the inhibitor is prepared by blending the amine and acid components and a solvent, if one is used, in a suitable reaction chamber and heating the reaction mixture to the desired temperature. When the amidization reaction is completed or substantially completed some or all of the solvent present is removed, as well as the water of reaction formed in the condensation reaction. The resulting adduct is then either neutralized by the acid or reacted with the oxirane compound. The finished product is then ready for use as an inhibitor.

The corrosion inhibitor can be added either on a continuous or an intermittent basis. In the former case it can be mixed with a carrier stream and introduced into the annulus of a well, the pipeline or the storage tank to be protected by proportionating pumps. When it is desired to add the inhibitor on an intermittent basis it is simply injected periodically into the carrier stream. The latter procedure is generally adequate when the corrosion inhibitor is able to form a good bond to the surfaces to be protected or when the fluids being transported through the pipeline have relatively small amounts of corrosive materials.

The above composition may be used alone or it may be mixed with other additives which it is desired to add to the carrier liquid being pumped into the well annulus or pipeline. Typical additives include surfactants, scale inhibitors or other corrosion inhibitors, such as vapor phase corrosion inhibitors.

The following examples illustrate specific embodiments of the invention. Unless otherwise indicated, parts and percentages are on a weight basis.

EXAMPLE I

To a 2-liter three-neck flask equipped with a stirrer, a thermometer, and a condenser-receiver trap assembly charged 345 gm of amine component having an amine value of 107 and the analysis indicated in Table I, 487 gm of acid component having an acid value of 147 and the analysis indicated in Table I, and 200 gm of xylene. The mixture is heated, with continuous stirring, to the temperature at which water is given off. The heating is continued under reflux conditions for 6 hours. The maximum temperature reached during the reaction period is 160°C. At the end of the reaction 32 ml of aqueous liquid is accumulated in the receiver trap. The resulting product contains 80% of amine-amide adduct having a combining number of 505 (determined by titration of a sample of the product with 1N HCl to a pH of 3.5) and 20% xylene. The number average molecular weight of the amine-amide adduct is 1010.

TABLE I

| Amine Component Analysis | |
|---|---|
| Component | Weight % |
| 1,6-hexanediamine | 5.0 |
| Di(1,6-hexanediamine)triamine | 30.0 |
| Tri(1,6-hexanediamine)-tetraamine | 50.0 |
| Higher homologues of 1,6-hexanediamine | 10.0 |
| Impurities | 5.0 |

| Acid Component Analysis | |
|---|---|
| Component | Weight % |
| $C_{18}$ aliphatic acids(monofunctional) | 7.0 |
| $C_{20}$ aliphatic acids(monofunctional) | 6.0 |
| Rosin acids | 13.0 |
| Dimer acid($C_{36}$–$C_{40}$ dibasic acids) | 45.0 |
| Trimer acid($C_{54}$–$C_{60}$ tribasic acids) | 20.0 |
| Higher homologues of the $C_{18}$–$C_{20}$ acids | 5.0 |
| Unsaponifiable oils | 2.0 |
| Other impurities | 2.0 |

EXAMPLE II

To 310 gm of product prepared according to Example I are slowly added 40g of glacial acetic acid (with cooling to prevent the temperature of the reaction mixture from exceeding 66°C) and 650 gm of xylene to yield an acetate salt containing 28.8% by weight of neutralized amine-amide product in xylene. The product has a pH of 6.5.

EXAMPLE III

To 200 gm of product prepared according to Example I are added 150 gm of the acid component of Example I (with cooling to prevent the temperature from exceeding 66°C) and 650 gm of xylene. The resulting product has a pH of 7.5 and contains 31% by weight neutralized amine-amide adduct.

EXAMPLE IV

To a stainless steel autoclave equipped with a heating mantle and stirrer is introduced 750 gm of product prepared according to Example I and 4 gm of KOH. The mixture is heated to 135°C and purged with nitrogen. To this mixture is incrementally added, with continuous stirring, 600 gm of ethylene oxide under nitrogen pressure. The rate of addition is controlled such that the reactor pressure does not exceed 40 psig and the temperature is maintained in the range of 135°–150°C. The resulting product contains 88.9% reaction product having a number average molecular weight of 2020 and 11.1% xylene.

EXAMPLE V

The procedure of Example IV is repeated except that 960 gm of product prepared according to Example I is reacted with 240 gm of propylene oxide. The resulting product has a number average molecular weight of 1250 and is comprised of 84% reaction product and 16% xylene.

EXAMPLE VI

The inhibitors prepared in Examples II to VI are tested for film persistency and inhibiting effectiveness as follows:

A. Film Persistency Test

Four inhibited solutions are prepared by mixing 2.5 parts by weight of the inhibitors prepared in Examples II to V with 97.5 parts by weight of a test fluid containing 70% by weight water saturated with carbon dioxide and 50,000 total dissolved salt solids and 30% by weight uninhibited kerosene saturated with carbon dioxide. The inhibited solutions are poured into clean 12 oz soft drink bottles containing weighed mild steel coupons having dimensions of 3 × ½ × 5 mils and which were scrubbed clean of all film and dirt. A fifth test bottle is prepared as above but without inhibitor. The bottles are sealed and rotated on a wheel for 2 hours at 150°F, after which the coupon samples are removed from the bottles, washed with distilled water and placed in clean bottles containing uninhibited test fluid. The bottles are again sealed and rotated for two additional hours at 150°F, after which the coupon samples are removed, rinsed with distilled water, and placed in clean bottles containing uninhibited test fluid. The bottles are again sealed and solutions are for 24 additional hours at 150°F, after which the coupon samples are removed, scrubbed to remove all film and dirt and weighed and the weight loss determined. The results of this test are reported in Table II. Runs 1 to 4 represent tests using the inhibitor prepared in Examples II–V, respectively. Run 5 is the control representing the uninhibited test liquid.

B. Corrosion Resistance Test

Four inhibited solutons are prepared by adding 100 ppm of the corrosion inhibitors prepared in Examples II to V to clean 12 oz soft drink bottles containing cleaned and weighed coupon samples and test fluid comprised of 70% by weight water saturated with carbon dioxide, and containing 50,000 total dissolved salt solids and 300 ppm hydrogen sulfide and 30% by weight uninhibited kerosene saturated with carbon dioxide and containing 300 ppm hydrogen sulfide. A fifth test bottle is prepared as above but without inhibitor. The bottles are sealed and rotated on a wheel for 48 hours at 150°F. The coupon samples are then removed, scrubbed and weighed and the weight loss determined. The results of this test are reported in Table II. As noted above, Runs 1 to 4 represent tests using the inhibitor prepared in Examples II to V, respectively and Run 5 is the control.

TABLE II

| Run | Film Persistency Test Weight Loss, mg | Constant Concentration Test Weight Loss, mg |
|---|---|---|
| 1 | 2.5 | 18.3 |
| 2 | 11.7 | 12.8 |
| 3 | 24.7 | 4.6 |
| 4 | 15.5 | 31.9 |
| 5 | 61.8 | 91.3 |

The above examples illustrate the excellent film persistency and corrosion resistance of the inhibitors of the invention. As can be appreciated, mixtures of the inhibitors can be used to obtain improved film persistency and corrosion resistance.

Although the invention is illustrated by the use of specific working examples, it is understood that the scope of the invention is limited only by the breadth of the appended claims.

I claim:

1. A ferrous metal corrosion inhibitor prepared by a. forming a primary amine-terminated amide adduct having a molecular weight of about 800 to 1500 by reacting a polyamine component containing at least 85% by weight of a mixture containing about 1 to 50% 1,6-hexanediamine, about 10 to 60% 1,6-hexanediamine dimer and about 10 to 70% 1,6-hexanediamine trimer with an organic acid component containing at least 85% by weight of a mixture containing about 10 to 40% monofunctional carboxylic acid having 15–23 carbon atoms, about 20–70% difunctional aliphatic carboxylic acids containing 36–40 carbon atoms, and about 10–40% trifunctional aliphatic carboxylic acids containing 54–60 carbon atoms, said acid component being free of compounds having atoms which interfere with the formation of the desired product or its effectiveness as a corrosion inhibitor, the relative amounts of polyamine component and organic acid component being such that the ratio of primary amine groups to carboxyl groups in the reaction mixture is about 1.8 to 3.0; and b. neutralizing the primary amine-terminated adduct with a saturated or ethylenically unsaturated aliphatic acid having 2 to 60 carbon atoms.

2. The corrosion inhibitor of claim 1 wherein the polyamine component contains at least 90% of a mixture containing about 1 to 35% 1,6-hexanediamine, about 20 to 40% 1,6-hexanediamine dimer and about 30–60% of 1,6-hexanediamine trimer and said organic acid component contains at least 90% of a mixture containing about 20 –30% monofunctional carboxylic acid having 15–23 carbon atoms, about 30 to 55% difunctional aliphatic carboxylic acid containing 36–40 carbon atoms and about 15 to 30% trifunctional aliphatic carboxylic acid containing 54–60 carbon atoms.

3. The corrosion inhibitor of claim 1 wherein said adduct is neutralized with said organic acid component.

4. The composition of claim 1 wherein said adduct is neutralized with a saturated aliphatic acid having 2 to 12 carbon atoms.

5. A ferrous metal corrosion inhibitor prepared by a. forming a primary amine-terminated amide adduct having a molecular weight of about 800 to 1500 by reacting a polyamine component containing at least 85% by weight of a mixture containing about 1 to 50% 1,6-hexanediamine, about 10 to 60% 1,6-hexanediamine dimer and about 10 to 70% 1,6-hexanediamine trimer with an organic acid component containing at least 85% by weight of a mixture containing about 10 to 40% monofunctional carboxylic acid having 15–23 carbon atoms, about 20–70% difunctional aliphatic carboxylic acids containing 36–40 carbon atoms, and about 10–40% trifunctional aliphatic carboxylic acids containing 54–60 carbon atoms, said acid component being free of compounds having atoms which interfere with the formation of the desired product or its effectiveness as a corrosion inhibitor, the relative amounts of polyamine component and organic acid component being such that the ratio of primary amine groups to carboxyl groups in the reaction mixture is about 1.8 to 3.0; and b. reacting the primary amine-terminated adduct with about 10 to 75%, based on the total weight of alkylene oxide and amide adduct in the product, of a saturated aliphatic oxirane compound having 2 to 6 carbon atoms.

6. The corrosion inhibitor of claim 5 wherein the polyamine component contains at least 90% of a mixture containing about 1 to 35% 1,6-hexanediamine, about 20 to 40% 1,6-hexanediamine trimer and said organic acid component contains at least 90% of a mixture containing about 20–30% monofunctional carboxylic acid having 15–23 carbon atoms, about 30 to 55% difunctional aliphatic carboxylic acid containing 36–40 carbon atoms and about 15 to 30% trifunctional aliphatic carboxylic acid containing 54–60 carbon atoms.

7. The corrosion inhibitor of claim 5 wherein the amount of oxirane compound reacted with the amine-terminated adduct is about 25–65%, based on the total weight of alkylene oxide and amide adduct in the product.

8. The corrosion inhibitor of claim 5 wherein said oxirane compound is ethylene oxide.

9. The corrosion inhibitor of claim 5 wherein said oxirane compound is propylene oxide.

10. A method of preparing a ferrous metal corrosion inhibitor comprising the steps of a. forming a primary amine-terminated amide adduct having a molecular weight of about 800 to 1500 by reacting a polyamine component containing at least 85% by weight of a mixture containing about 1 to 50% 1,6-hexanediamine, about 10 to 60% 1,6-hexanediamine dimer and about 10 to 70% 1,6-hexanediamine trimer with an organic acid component containing at least 85% by weight of a mixture containing about 10 to 40% monofunctional carboxylic acid having 15–23 carbon atoms, about 20–70% difunctional aliphatic carboxylic acids containing 36–40 carbon atoms, and about 10–40% trifunctional aliphatic carboxylic acids containing 54–60 carbon atoms, said acid component being free of compounds having atoms which interfere with the formation of the desired product or its effectiveness as a corrosion inhibitor, the relative amounts of polyamine component and organic acid component being such that the ratio of primary amine groups to carboxyl groups in the reaction mixture is about 1.8 to 3.0; and b. neutralizing the primary amine-terminated adduct with a saturated or ethylenically unsaturated aliphatic acid having 2 to 60 carbon atoms.

11. A method of preparing a ferrous metal corrosion inhibitor comprising the steps of a. forming a primary amine-terminated amide adduct having a molecular weight of about 800 to 1500 by reacting a polyamine component containing at least 85% by weight of a mixture containing about 1 to 50% 1,6-hexanediamine, about 10 to 60% 1,6-hexanediamine dimer and about 10 to 70% 1,6-hexanediamine trimer with an organic acid component containing at least 85% by weight of a mixture containing about 10 to 40% monofunctional carboxylic acid having 15–23 carbon atoms, about 20–70% difunctional aliphatic carboxylic acids containing 36–40 carbon atoms, and about 10–40% trifunctional aliphatic carboxylic acids containing 54–60 carbon atoms, said acid component being free of compounds having atoms which interfere with the formation of the desired product or its effectiveness as a corrosion inhibitor, the relative amounts of polyamine component and organic acid component being such that the ratio of primary amine groups to carboxyl groups in the reaction mixture is about 1.8 to 3.0; and b. reacting the primary amine-terminated adduct with about 10 to 75%, based on the total weight of alkylene oxide and amide adduct in the product, of a saturated aliphatic oxirane compound having 2 to 6 carbon atoms.

12. A method of inhibiting corrosion of ferrous metal comprising contacting the metal with the corrosion inhibitor of claim 1.

13. A method of inhibiting corrosion of ferrous metal comprising contacting the metal with the corrosion inhibitor of claim 3.

14. A method of inhibiting corrosion of ferrous metal comprising contacting the metal with the corrosion inhibitor of claim 4.

15. A method of inhibiting corrosion of ferrous metal comprising contacting the metal with the corrosion inhibitor of claim 5.

16. A method of inhibiting corrosion of ferrous metal comprising contacting the metal with the corrosion inhibitor of claim 7.

* * * * *